United States Patent [19]

Saget

[11] 4,295,600

[45] Oct. 20, 1981

[54] APPARATUS FOR THE CENTRIFUGAL SEPARATION OF AT LEAST TWO LIQUID PHASES AND ONE SEDIMENTARY PHASE OF A MIXTURE

[76] Inventor: Pierre L. Saget, 36, avenue de la Grande Armée, Paris, France, 75017

[21] Appl. No.: 122,472

[22] Filed: Feb. 19, 1980

[30] Foreign Application Priority Data

Feb. 23, 1979 [FR] France ..... 79 04748

[51] Int. Cl.[3] ..... B04B 1/04; B04B 1/20

[52] U.S. Cl. ..... 233/7; 233/17; 233/19 A

[58] Field of Search ..... 233/7, 17, 19 A

[56] References Cited

U.S. PATENT DOCUMENTS

| | | | |
|---|---|---|---|
| 1,710,316 | 4/1929 | Laughlin | 233/7 |
| 3,348,767 | 10/1967 | Ferney | 233/7 |
| 3,623,656 | 11/1971 | Lavanchy | 233/7 |
| 4,042,172 | 8/1977 | Nozdrovsky | 233/7 |

FOREIGN PATENT DOCUMENTS

| | | | |
|---|---|---|---|
| 1103854 | 3/1961 | Fed. Rep. of Germany | 233/7 |
| 1395820 | 3/1965 | France | 233/7 |
| 297914 | 10/1928 | United Kingdom | 233/7 |

*Primary Examiner—Primary Examiner*—Philip R. Coe
*Attorney, Agent, or Firm*—James E. Nilles

[57] ABSTRACT

The apparatus comprises around a nozzle supplying the mixture to be treated, a rotating sealed enclosure wherein an annular partition separates two chambers communicating together via a peripheral passage, containing chiefly the separated heavy phase and light phase and provided with thresholds for the draining thereof. According to the invention, the two chambers are equipped with separate centrifuge devices, connected to apparatus for driving them in rotation, which apparatus moves them at different angular speeds. The invention finds an application for example in the extraction of animal and vegetable fatty substances, in the extraction of essential oils, in the production of fat-free animal proteins, in the recovery of polymers from solvent-water mixed mediums, in the extraction of antibiotics, in metallurgical refinings with selective solvents, in the desalination of sea water by the solvent method, in the treatment of waste waters, etc.

11 Claims, 13 Drawing Figures

Figure 1:
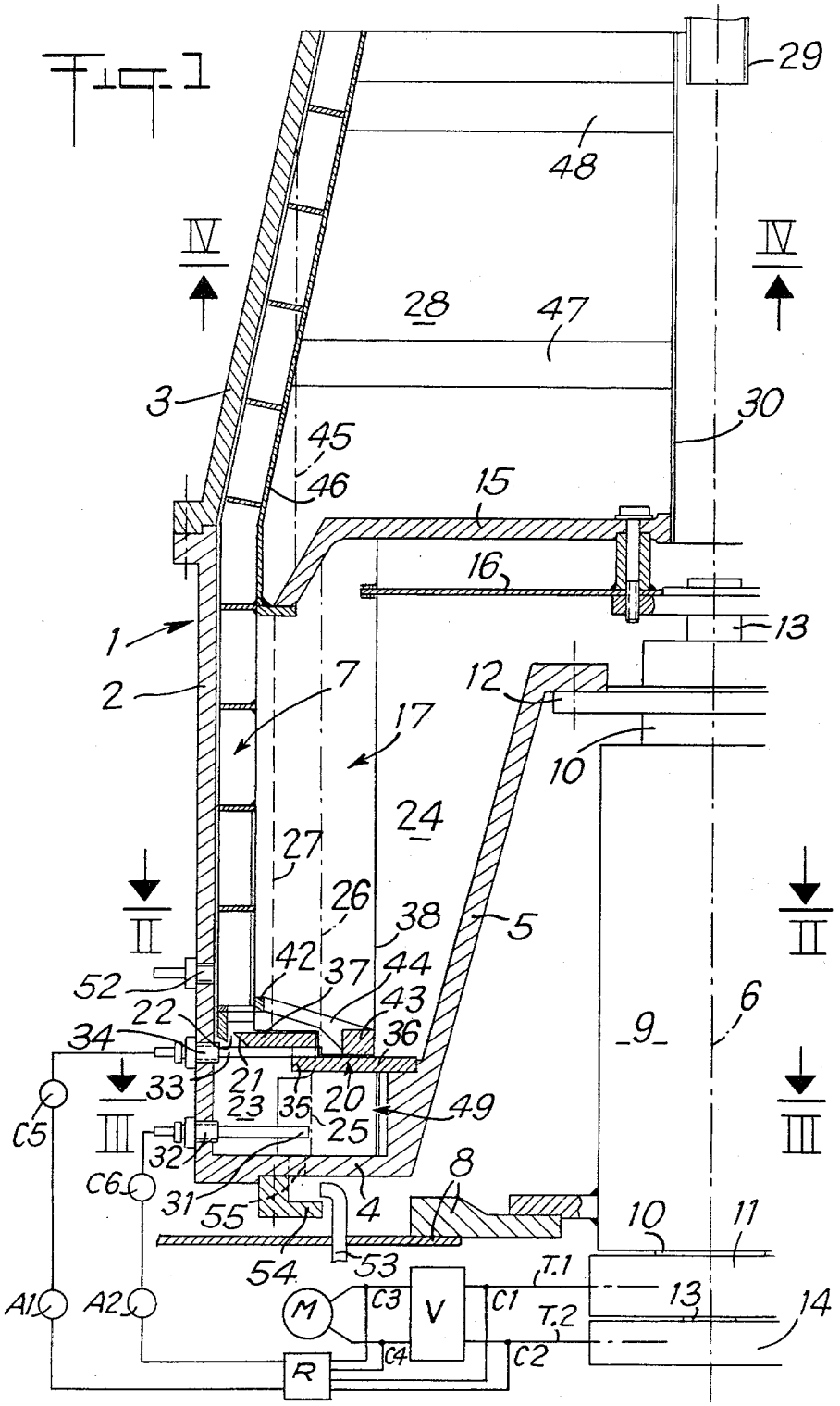

29
48
IV
IV
28
47
3
30
45
46
15
16
13
1
2
7
12
17
10
24
27
26
38
5
II
II
52
42
37
44
43
22
36
9
6
34
21
33
23
35
20
49
C5
III
III
25
32
8
C6
31
55
4
10
11
54
53
T.1
A1
A2
M
C3
V
C1
13
14
T.2
C4
C2
R

APPARATUS FOR THE CENTRIFUGAL SEPARATION OF AT LEAST TWO LIQUID PHASES AND ONE SEDIMENTARY PHASE OF A MIXTURE

The present invention relates to an improved apparatus for the centrifugal separation of at least two liquid phases and one solid sedimentary phase composing a mixture, a mixture such as for example a crude olive oil.

The improvements according to the invention can be applied to the type of apparatus described in the DTAS No. 1 103 854. Said type of apparatus comprises, around a nozzle which supplies the mixture to be treated, a rotating enclosure whose peripheral wall is closed by a coronal base and which is connected to a first rotating means. Said enclosure is integral with an annular wall dipping into the mixture beyond the interface of the phases thereof, to separate a first chamber containing only the heavy phase, from a second chamber containing the light phase "floating on the surface" of the heavy phase, whilst providing a peripheral annular passage for conveying the said heavy phase from the second chamber towards the first. Said enclosure is further provided with separate thresholds for the discharge of the phases and cooperates with a helical sediment conveyor. Said conveyor is coupled to a second means for driving it in rotation, via a plate which dips into the mixture beyond the aforesaid interface and separates the second chamber from a cavity with which it nevertheless communicates on the periphery through the said conveyor to transfer the sediments through the heavy phase. Finally, the conveyor is also integral with a centrifuge device plunging at least into the light phase of the second chamber.

This type of known apparatus is not really satisfactory since the extracted light phase—the oil—is not pure and still contain a large proportion of heavy phase—water for example—as well as some sediments making it cloudy, whilst another proportion of the light phase is lost through escaping with the extracted heavy phase.

It is therefore the aim of the invention to overcome this great disadvantage and to improve this type of apparatus so that the totality of the light phase can be extracted from the mixture, i.e. without any losses, and in a perfectly pure state, and that the same happens with the heavy phase.

First of all, the Applicant noted that the centrifuge device of the second chamber containing the light phase "floating" on the surface of the heavy phase, does not drive the said light phase at an absolutely constant angular speed and that the said centrifuge device only fills but a limited part of the said second chamber. The Applicant also noted that the first chamber contains no centrifuge device capable of driving the heavy phase at a constant angular speed. Finally, the Applicant noted that there is nothing preventing sediments from being carried by the heavy phase towards the first chamber and from blocking the passage joining the two chambers.

The Applicant also noted during specific tests that, if the mass of the mixture to be treated is permanently driven in rotation at a constant speed in every point, the tangential speed of every particle in the flow is strictly proportional to the said constant angular speed and to the radius of the point where the said particle is found to be located; such a flow obviously causes the separation of the phases constituting the mixture which phases are divided into concentric "superimposed" layers, perfectly defined and separated by a very neatly positioned interface.

The Applicant also noted that if, on the contrary, the mass of the mixture to be treated is not driven in rotation at a constant angular speed in every point, said mixture then adopts systematically a vortex and irrotational flow, i.e. a flow wherein each particle moves at a tangential speed which is inversely proportional to the radius and at the same time turns around adjacent particles but not on itself. This type of flow which causes a mixture, is exactly the reverse of the preceding flow which causes a separation.

In addition, the Applicant noted that the zone of transition between the two types of flow is extremely narrow; for example, a few millimeters away from the centrifuge device—when there is one and when it really drives at a constant angular speed the whole mass of the mixture inside which it plunges—the said mixture flows as an irrotational vortex; in other words, whereas, in the area where the centrifuge device intervenes, the phases of the mixture tend to separate, on the outside said phases tend to remain mixed; it should also be noted that the stable phenomenon is that of the vortex and that it tends to be propagated within the centrifuge device causing then the re-mixing up of the phases as and when these are separated by the said device.

The applicant finally noted that if the aforesaid vortex flow starts in the first chamber, whereas a flow with a constant angular speed has already started in the second chamber, the interface is instable and its "level" fluctuates all the more that there is little difference between the densities of the two liquid phases. This phenomenon seems to be due to the fact that the field of pressure in the first chamber where there is a vortex flow is badly defined and irregular; as a result, the hydrostatic balance of the phases in the two chambers can be neither guaranteed nor stabilized. Thereafter, the fluctuations of the interface irremediably lead to periodical partial draining of the thresholds, i.e. to massive discharges of heavy phase with light phase or of light phase with heavy phase. This phenomenon becomes virtually negligible only if the densities of the phases are noticeably different.

These observations have made it possible to determine one of the causes for the inefficiency of the aforesaid known apparatus in separating the phases of a mixture and, consequently, to determine what improvements should be made. In effect, the centrifuge device of the second chamber should really be shaped so as to generate a flow with a constant angular speed and said centrifuge device should be concerned with the whole mass of the mixture contained in the said second chamber as far as near to the annular passage which connects it with the first chamber; said first chamber should also contain a centrifuge device acting on the quasi totality of the heavy phase contained in said chamber.

Another cause for the inefficiency of the known apparatus is that the transfer of the heavy phase between the two chambers is not guaranteed in the best conditions and that it causes disturbances relatively to the flows of phases in the two chambers, which flows should have a constant angular speed.

Yet another cause for the efficiency of the aforesaid known apparatus is the considerable instability of the interface of the phases in the second chamber. Indeed, the tests conducted by the Applicant have shown that a slight variation of the rotation speed ratio of the liquid phases in the chambers entails a greater variation of the radius of the interface, especially if there is little difference in the speeds of rotation. These same tests have also shown that, if there is little difference between the densities of the two liquid phases, the instability of the interface is increased. In fact, the Applicant has experimentally proved the equilibrium law and he has noted that the ratio of the rotation speeds k intervenes through the factor $k^2$ -1 and that the ratio of the phases densities m intervenes through the factor m - 1.

Thereafter, to stabilize the interface in the case where the ratio of the densities is scrupulously constant it is necessary for the two means driving the centrifuge devices in rotation to be controlled via a means for regulating the ratio of their speeds. Moreover, and considering that, in general, the ratio of the densities of the phases is not constant, it remains necessary, in order to stabilize the interface, to have the regulating means cooperating with a control member sensitive to the density of one of the liquid phases, to the limpidity of one of same or to other values which can be measured at the corresponding overflow threshold.

It is important to note that these improvements are necessary to benefit from the advantage resulting from the driving in rotation at different speeds, of the enclosure on the one hand, and of the conveyor, integral with the centrifuge device, on the other. The said advantage is that the phases are really subjected to centrifugal fields of different strengths, whereas there may be little difference between the densities of these phases.

According to the invention, a first centrifuge device is housed in the first chamber, is integral with the walls thereof, and, depending on whether it is of the type with radial or inclined blades, or with conical plates or with perforated and flanged plates, or any other type, is provided with surfaces extending inside the entire treated volume, across their circular movement, in order to transmit the rotation of the first driving means to the heavy phase according to an angular speed which is scrupulously constant throughout its whole mass and in very one of its points; the second centrifuge device, housed in the second chamber, is integral with the plate, extends along the said chamber to arrive as close as possible to the partition wall, to the light phase overflowing threshold and to the annular passage of the heavy phase, and it is provided, whether it is of the type with radial or inclined blades, with conical plates, or with perforated and flanged plates or any other type, with surfaces extending through the entire treated volume, across their circular movement, in order to transmit the rotation of the second driving means to at least the light phase, according to an angular speed which is scrupulously constant throughout its whole mass and in every one of its points, thus opposing the natural tendency of this type of flow with constant angular speed to degenerate into an irrotational vortex flow (with tangential speed inversely proportional to the radius), which would destroy the stability of the interface and would lead to a re-mixing of the phases, and the two means for driving the centrifuge devices are controlled by means of a device for stabilizing and regulating the ratio of their respective rotation speeds.

According to other characteristic features of the invention, the means for regulating the conjugated operation of the two rotation means cooperates with a control member which is sensitive to the densities and to the limpidity of the two liquid phases measured at the draining thresholds.

In addition, the outmost spire of the conveyor which is situated close to the wall dividing the chambers, is perforated to create another direct communication between said chambers, said perforation permitting to avoid the re-pumping up of the light phase towards the heavy phase.

The end of the conveyor which is situated under the partition between the chambers is integral with at least one scraping element extending close to the peripheral wall and directed into the annular passage in order to avoid any accumulation of sediments in the first heavy phase chamber, the said scraping element forming together with a generatrix of the enclosure an angle which can vary between 0° and 45°.

A labyrinth packing is interposed between the partition wall (dividing the two chambers) and a central continuous ring of the conveyor.

The overflowing thresholds are adjustable tubes provided on the peripheral wall and extending towards the periphery to issue on the outside of the enclosure, and level with the free surfaces of the heavy and light phases, respectively, into the chambers containing them; the partition rises in steps and is provided with a skirt connecting a central flank to a peripheral flank; the pipes taking up the light phase go through the skirt by resting against the peripheral flank in the first heavy phase chamber and against the central flank in the second light phase chamber, in that spot.

Figure 2:
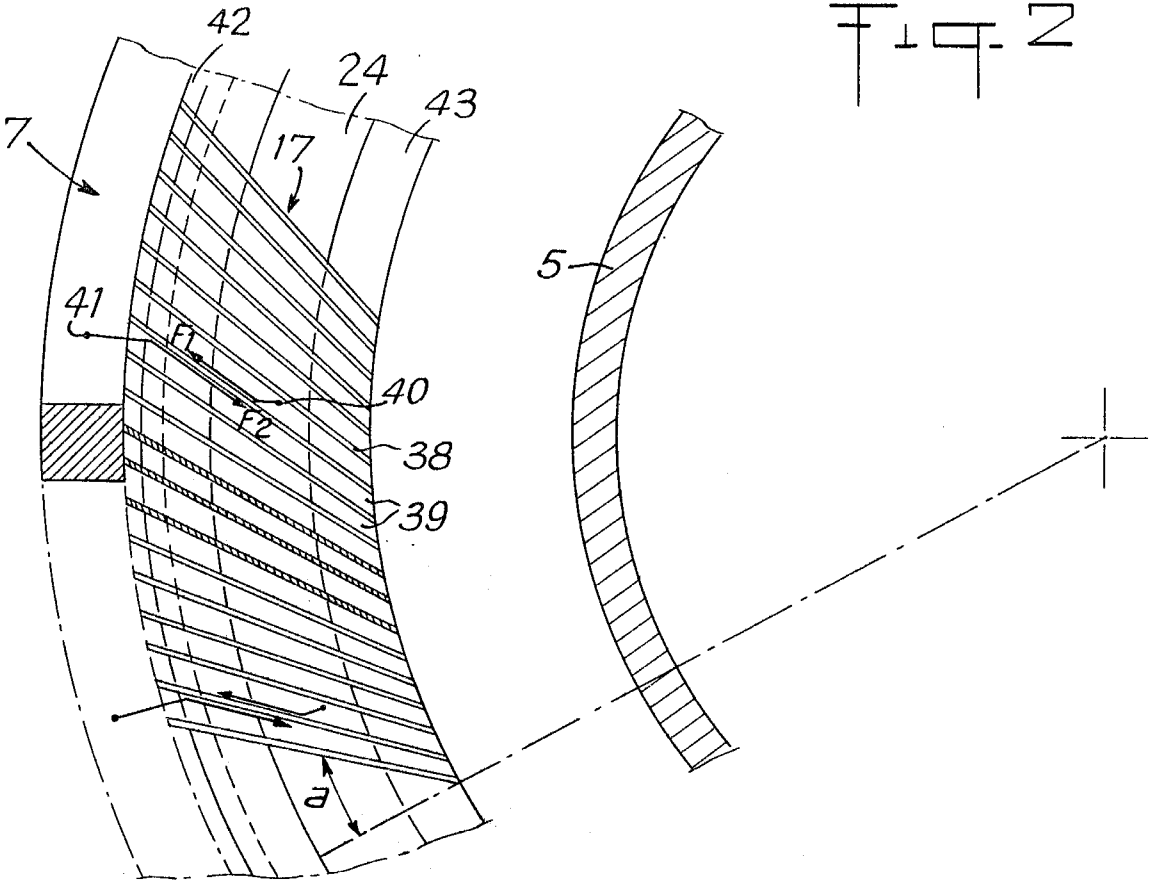
Figure 3:
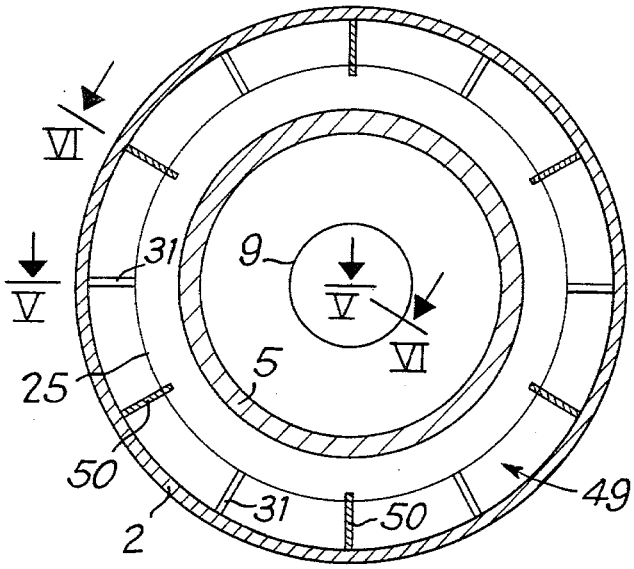
Figure 4:
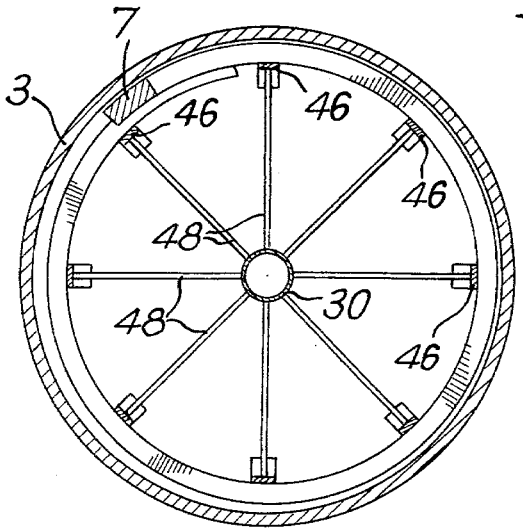
Figure 5:
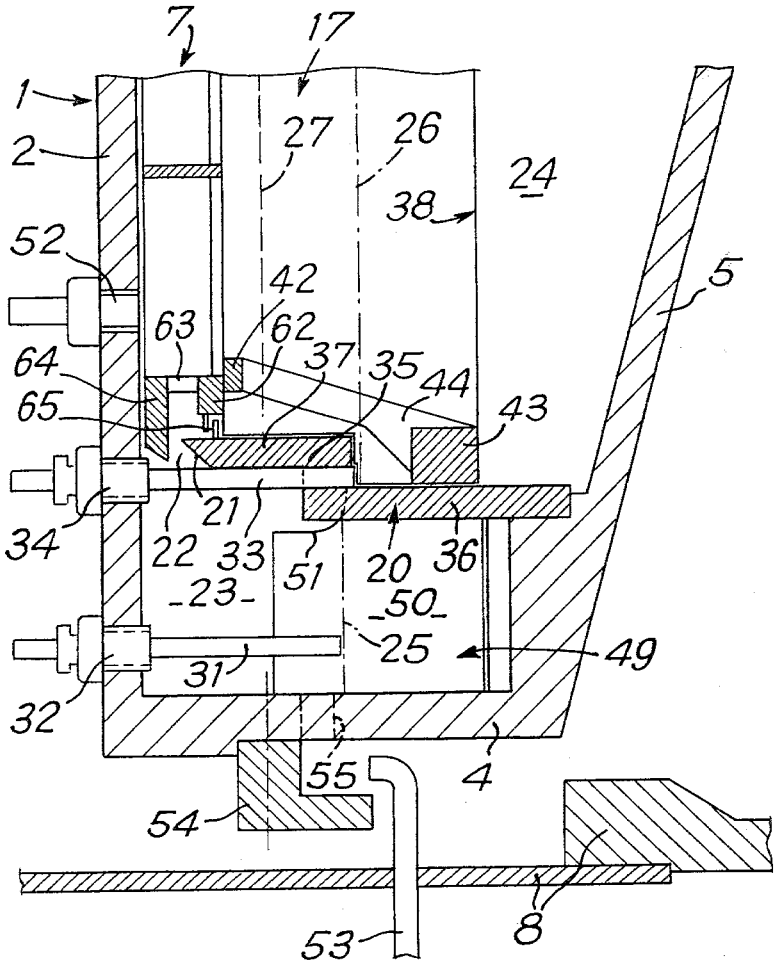
Figure 6:
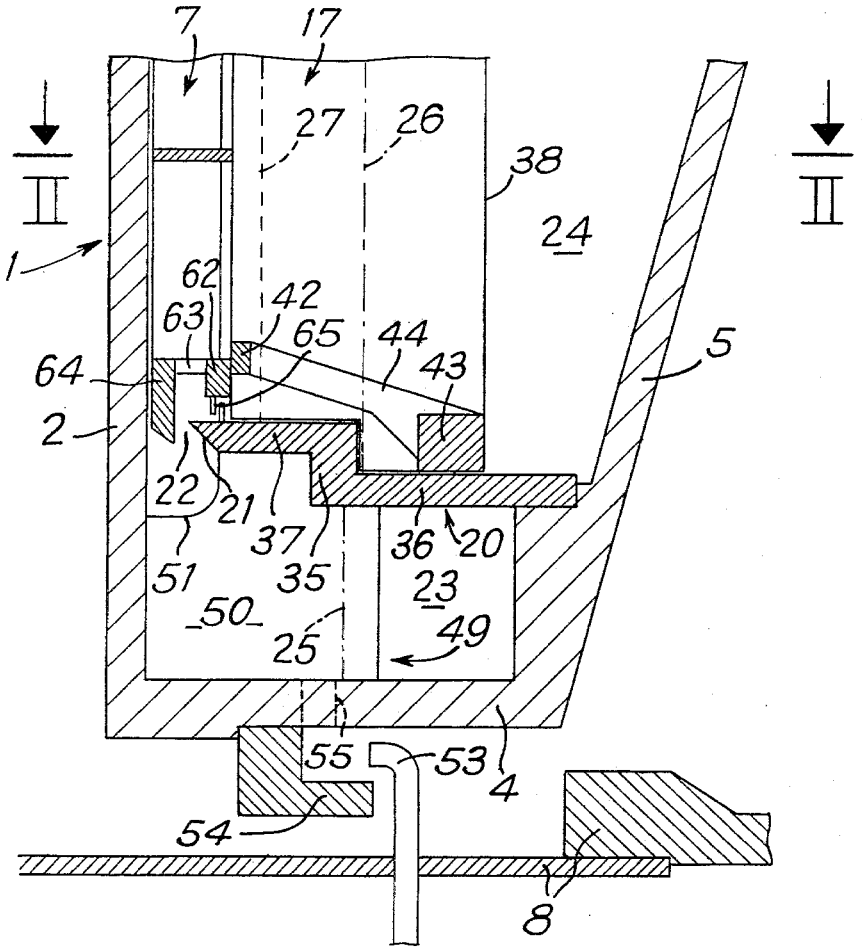
Figure 7:
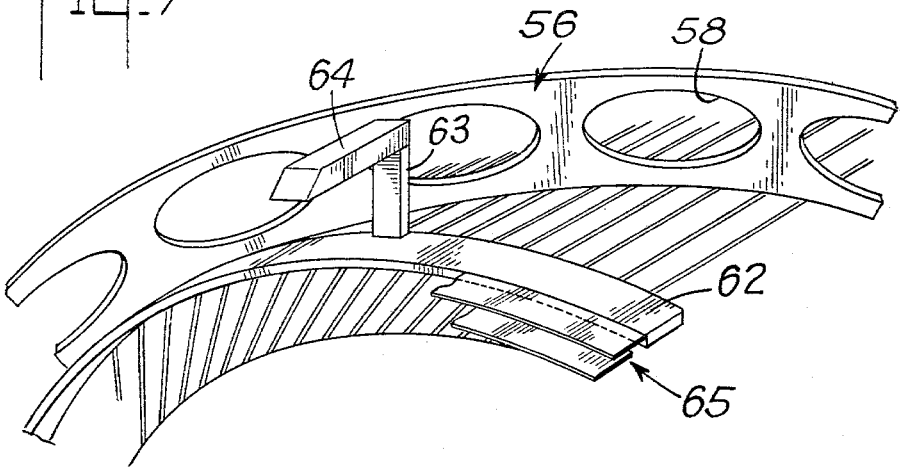
Figure 8:
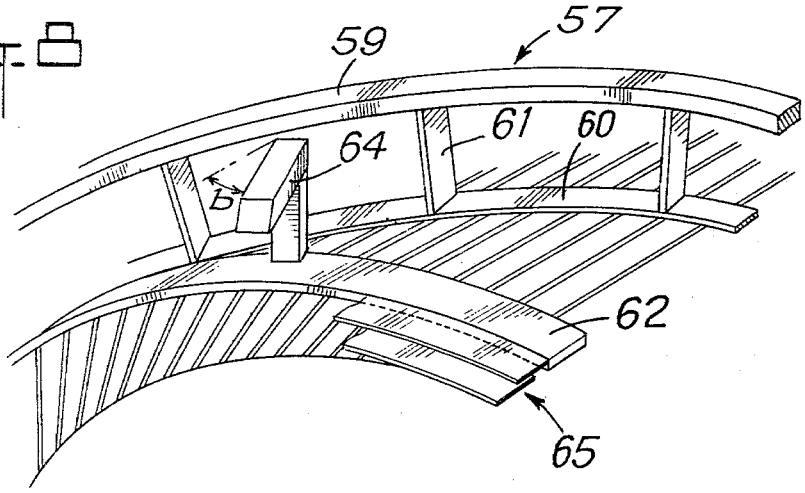
Figure 10:
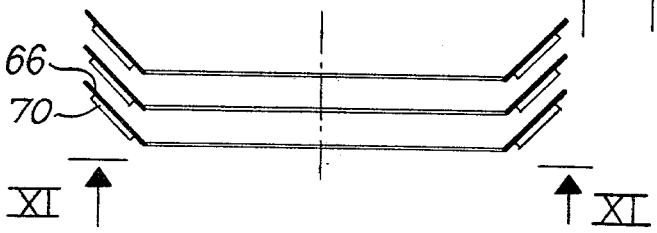
Figure 9:
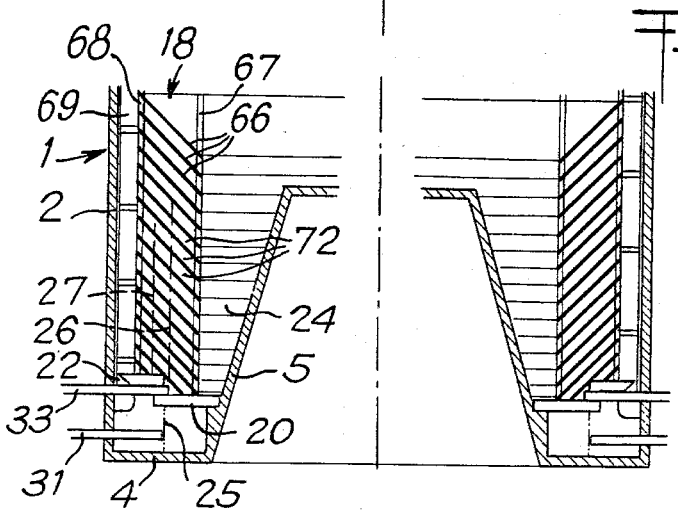

The invention will be more readily understood on reading the following description with reference to the accompanying drawings, in which:

FIG. 1 is an elevational half cross-section, showing a first embodiment of a centrifuge device according to the invention, permitting, concomitantly, to separate the liquid phases and to decant or clarify, FIG. 2 is a partial cross-section, on an enlarged scale, along line II—II of FIG. 1, FIGS. 3 and 4 are cross-sections, on a smaller scale, along lines III—III and IV—IV respectively of FIG. 1, FIGS. 5 and 6 are partial cross-sections, on an enlarged scale, along lines V—V and VI—VI of FIG. 3, FIG. 7 and FIG. 8 are partial perspectives showing in detail and on an enlarged scale, two embodiments of the first spire of the conveyor, of a scraping element and of the means provided for controlling the flow of the heavy phase, FIG. 9 is an elevational view of a partial cross-section showing a second embodiment of the centrifuge device used in the treatment chamber, FIG. 10 is a diagram of an axial cross-section of the plates of the centrifuge device according to FIG. 9, the plates in the stack being at a distance from one another.

Figure 11:
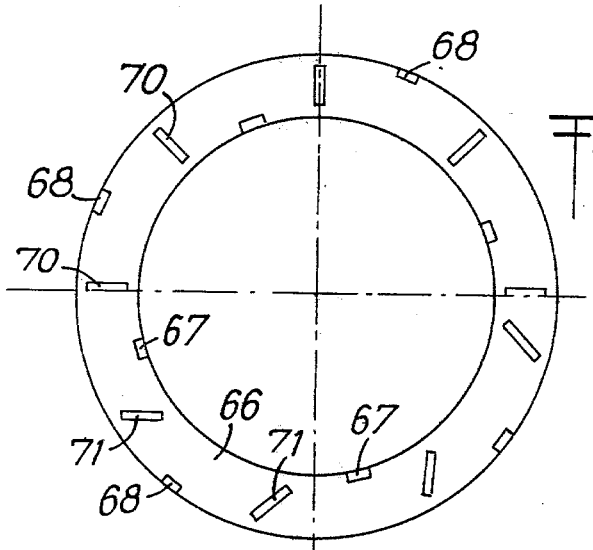
Figure 13:
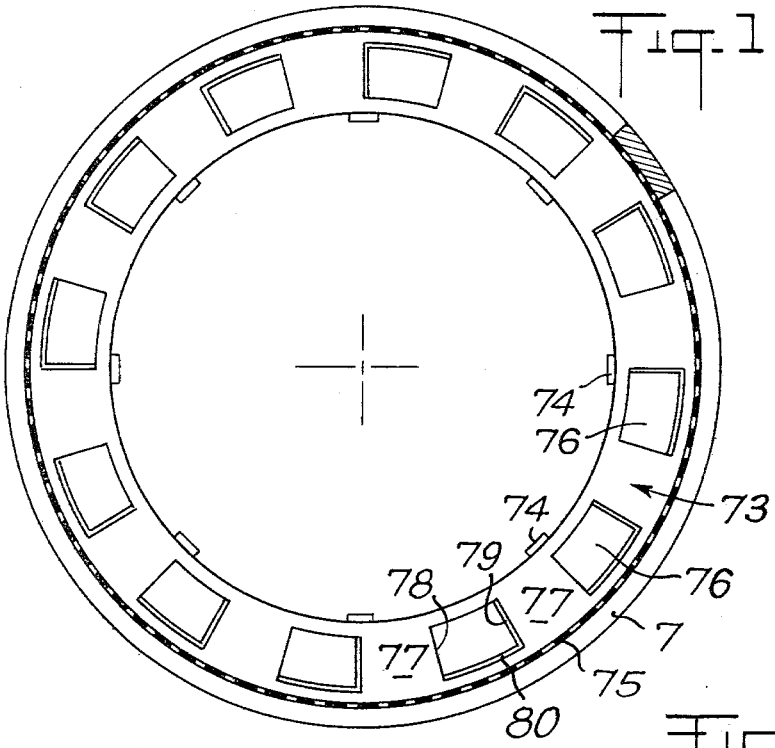
Figure 12:
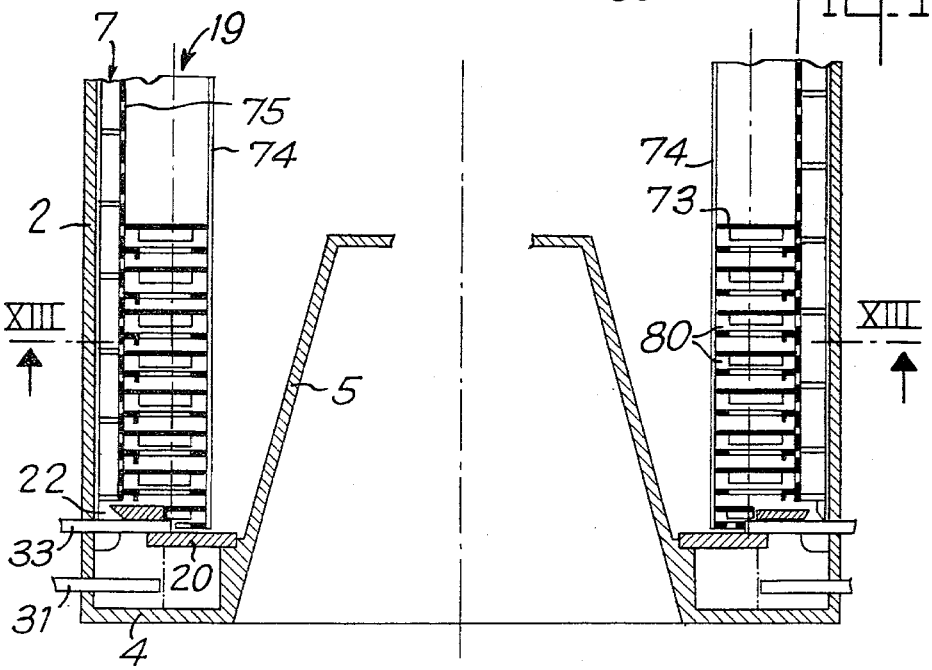

FIG. 11 is a plan view along line XI—XI of FIG. 10, the two halves of said view showing clearly two embodiments of the separating bars, FIG. 12 is an elevational view of a cross-section such as that shown in FIG. 9, illustrating the third embodiment of the centrifuge device, FIG. 13 is a plan view of a perforated disc, along line XIII—XIII of FIG. 12.

The apparatus illustrated in FIGS. 1 to 6 comprises a rotating enclosure constituted by a cylinder-shaped peripheral wall 2 extended by a truncated cone-shaped wall 3 and closed by a coronal base 4 integral with an equally truncated hub 5 penetrating inside.

In this example, the axis of rotation 6 of the apparatus is vertical and said apparatus contains a spiral conveyor 7 extending as close as possible to the inner surface of the walls 2 and 3, to remove any solid sediments projected against the said surface by the corresponding centrifuge field.

On a fixed frame 8 of the apparatus is fitted a sleeve 9 extending co-axially in the hub and provided with inner bearings supporting a tubular shaft 10 whose ends are fast with a driving pulley 11, and respectively, with a flange 12 to which the said hub 5 is coupled; the tubular shaft 10 is also provided with inner bearings co-axially supporting a central shaft 13 whose ends are provided with a driving pulley 14 adjoining the preceding one and, respectively, with two plates 15, 16 coupled together and made integral, by any suitable means, with a centrifuge device which is designated, depending on its type of embodiment, by references 17 (in FIGS. 1 to 8), 18 (in FIGS. 9 to 11) or 19 (in FIGS. 12 and 13).

The following description refers to the first embodiment 17, but it is quite obvious that the means now to be defined also apply to the other two embodiments.

The conveyor 7 is fitted around the device 17 and thus is driven at the same speed of rotation as said device by the pulley 14, which speed is different from that of the enclosure 1 driven by the pulley 11.

In addition, a partition 20 is fitted against a shoulder of the hub 5 and extends towards the wall 2 of the enclosure; the bevelled peripheral edge 21 of the said partition defines with the said wall an annular passage 22 which creates a permanent communication between the two chambers 23 and 24 divided by the said partition.

The annular-shaped chamber 23 is defined by the wall 2, the base 4 and the partition 20; it is meant to contain only the heavy liquid phase, which under normal centrifuging conditions, reaches the cylindrical level 25, concentric to the axis of rotation 6. The equally annular-shaped chamber 24 is defined by the wall 2, the partition 20 and the plate 15; it is meant to receive the mixture to be treated and to contain, in its central area in particular, the light phase, which, under the same conditions as aforestated, reaches the cylindrical level 26 which is also concentric to the axis of rotation 6 but closer thereto than the level 25 of the heavy phase. The interface between the heavy phase and the light phase is situated at the cylindrical level 25 only, in the chamber 24, the plate 15 preventing the light phase from crossing over and flowing towards the cavity 28 into which the solid sediments are discharged.

The mixture to be treated is distributed through a central nozzle 29 into a pipe 30 co-axially integral with the plate 15 and extending inside the cavity 28; said mixture arrives on the plate 16 which projects it radially into the centrifuge device 17, 18 or 19.

The heavy phase is removed from the chamber 23 through an overflowing threshold; preferably, this threshold is constituted by at least one radial pipe 31 (six of these being provided in the example shown in FIG. 3) carried by the peripheral wall 2, a threaded connection 32 permitting to adjust its projection and thus the level of its mouth which in turn determines the level of the free surface 25 of the heavy phase in the said chamber 23.

In a similar manner, the light phase is removed from the chamber 24 via an overflowing threshold of the same type; said threshold is then constituted by at least a radial pipe 33 carried on the peripheral wall 2, a threaded connection 34 permitting also to adjust its projection and as a result the level of its mouth which in turn determines that of the free surface 26 of the light phase in the said chamber 24.

But, for the centrifuge device 17, 18 or 19 to act positively up to the passage 22, the partition 20 rises in step manner and is provided with a skirt 35 connecting a central flank 36 which is fixed to the hub 5, to a peripheral flank 37 defining truly the passage 22. The pipes 33 which are meant to remove the light phase from the chamber 24, extend inside the chamber 23 against the peripheral flank 37, traverse the skirt 35 and issue very near to the latter into the said chamber 24 against the central flank 36; said pipes thus issue flush with the surface in the chamber 24. Therefore the centrifuge device 17 (or 18 or 19) can occupy the entire treatment volume of the said chamber 24; it is integral by one of its ends to the plate 15 and by its periphery to the conveyor; it extends along the chamber 24 and terminates, at its other end, as close as possible to the stepped partition 20; as a result, the shape of said last end of the centrifuge device is complementary to the stepped profile of the partition 20 provided with pipes 33, leaving only a minimum of play, about 1 or 2 mm, which play is necessary since the centrifuge device does not rotate at the same angular speed as the enclosure 1 and therefore as the partition 20.

The light and heavy phases flow through the pipes 31 and 33 respectively and gush out to be collected by fixed annular gutters.

In the embodiment shown in FIGS. 1 to 6, the centrifuge device 17 is constituted by a plurality of blades 38 extending longitudinally, i.e. in parallel to the rotation axis 6. Said blades are arranged side by side (FIG. 2) forming an angle "a" with the radial directions. Said angle "a" may vary, depending on the nature and the composition of the mixture, on the intensity of the centrifugal field, etc. . . . between 20° and 90°; but in the illustrated example, which relates to the purification of olive oil, the said angle is substantially equal to 40°. In any case, the blades 38 define, in pairs, passages 39 in which the heavy particles 40 are precipitated in centrifugal manner, on a blade face and deposit there to form a film which flows in the direction of the arrow F.1, along the slope, towards the periphery, to arrive at the chamber 23, whereas the light particles 41 are precipitated in centripetal manner onto the opposite blade face and deposit there to form a film which flows in the direction of arrow F.2, along the slope, towards the centre, to collect inside the chamber 24.

The blades 38 are rigidly held in position to form a rotor capable of withstanding the centrifuge field. To this effect the blades are welded at one of their ends onto the plates 15, 16 and, close to their other end, onto a central ring 42 and a peripheral ring 43 connected together by suitably distributed spokes 44; it is obvious that intermediate support wheels similar to the preceding one, 42 to 44 can be provided if the blades 38 are too long.

It is of course advantageous for the heavy phase, which lies in the cavity 28 up to the cylindrical level 45 (FIGS. 1 and 4), to be actuated at substantially the same speed of rotation as the heavy phase in the chamber 25. Then the cavity 20 contains no means for moving the liquid; however, the conveyor 7 must be held in position and to this effect its spires are joined together by longitudinal bars 46 directly coupled to the plate 15 and, via arms 47 and 48, to the pipe 30 thereof. In these conditions, if the enclosure 1 turns quicker than the conveyor 7, the total thickness of the phases treated in the chamber 23 can be increased whilst the heavy phase is kept to the level 45 in the cavity 28.

According to the embodiment illustrated in FIGS. 1 to 6, the chamber 23 contains a centrifuge device 49 driven by the pulley 11 at the same speed of rotation as the enclosure 1 and, consequently at a different speed from that of the aforesaid centrifuge device driven by the pulley 14. Said device 49 comprises, in the illustrated example (FIGS. 3, 5 and 6) six blades 50 extending in radial planes between the overflow-pipes 31 and made integral, through welding for example, with the wall 2 and the base 4, whilst adopting the stepped shape of the partition 20; so as not to disturb the flow of heavy phase from the chamber 24 towards the chamber 23, the blades 50 are provided with an indentation 51, facing the annular passage 22.

The pulleys 11 and 14 or any other coupling means should be driven in rotation at different angular speeds which speeds are the same as those retained for the centrifuge devices 17 and 49. Said centrifuge devices faithfully transmit the said speeds to the masses of the liquids contained in the chambers 24 and 23, so that said masses turn as a block. As already indicated hereinabove, the ratio of these rotation speeds needs to be regulated and controlled with great accuracy. To this effect and according to the embodiment diagrammatically illustrated by way of example in FIG. 1, the driving pulleys 11 and 14 or any other coupling means are connected by two independent transmissions T.1 and T.2 to the two outlets of a speed selector V driven by a motor M. On these two outlets of the said selector are connected speed sensors C.1 and C.2 which transmit the signals corresponding to the detected speeds to a regulator device R provided in order to stabilize the ratio of said speeds; to this effect, the regulator device R sends control signals to the terminals C.3 and C.4 of the circuits of the speed selector V controlling the two outgoing speeds.

With the apparatus described in the foregoing, it is possible to separate two liquid phases of a mixture whose densities are very similar, because the said liquid phases can be subjected to truly separating centrifugal fields of different strengths.

Moreover, if the mixture treated is composed of liquid phases whose densities are not absolutely constant, it suffices to modify the ratio of the speeds of rotation of the pulleys 11 and 14 to stabilize with accuracy the interface of the light and heavy phases in the chamber 24, at the level 27 which is dependent on the levels 25 and 26 to which the overflow-pipes 33 and 31 are adjusted.

For example, the mixture can be a crude olive oil and it is a known fact that the density of the purified oil can vary depending not only on the origin of the olives and but also on many other parameters.

In order to alter the ratio of the speeds of rotation, it suffices to measure a significant quantity automatically at the outlet of the overflow pipes and to compare the short-time values with control values to issue the signals representative of the variations thus detected, such signals being then directed towards the regulator device R so that the latter acts on the speed selector V as indicated hereinabove.

The significant quantity may be the density of the phases flowing through the overflow pipes in question, the limpidity of the phases, etc. . . . In any case, whatever the significant quantity selected, comparator-sensors C.5 and C.6 for these quantities are connected to the overflow-pipes 33 and 31 for example and coupled to the said regulator device R via control members A.1 and A.2.

Moreover, if the mixture contains mucilaginous sediments, the conveyor 7 cannot discharge these towards the mouth of the conical partition 3. It is then necessary, in order to avoid any harmful deposit, to remove them as and when they appear against the cylindrical wall 2. To this effect, the said wall is provided with at least one calibrated orifice 52 which issues into the chamber 24 near the stepped partition 20 and channels the said sediments, mixed with heavy phase, towards the outside, where they are squirted into a fixed annular discharge gutter. The orifice or orifices 52 are scraped by the helical conveyor 7 in order to prevent any blockage. Of course, to maintain the balances, it is preferable to compensate this fluid flow, with a supplementary flow of heavy phase. To this end, a nozzle 53 fitted in the frame 8 and adequately supplied under low pressure, issues opposite an annular gutter 54, integral with the base 4 of the rotating enclosure 1, the said gutter communicating with the chamber 23 by at least one opening 55.

In the apparatus such as illustrated in FIGS. 1 to 6, it is important to use means to avoid the light phase contained in the chamber 24 having to be re-pumped towards the heavy phase contained in the chamber 23, through the annular passage 22; such re-pumping risks to occur because of the flux and reflux that the first spire of the conveyor 7 causes to appear in the region of the stepped partition 20.

One means recommended in order to avoid the considered re-pumping, consists in providing perforations in the said first spire 56 (FIG. 7) or 57 (FIG. 8) so as to create another direct communication between the chambers 23 and 24 through the conveyor 7 proper.

According to an embodiment illustrated in FIG. 7, the first spire 56 defines openings 58 which are close enough together to destroy any fluctuations in the flow of heavy phase from one chamber to the other.

According to another embodiment illustrated in FIG. 8, the first spire 57 is constituted by two threads 59 and 60 which extend respectively in the peripheral part and in the central part of the conveyor, said threads being kept apart one from the other by means of crosspieces 61 defining apertures between them, which apertures have the same functions as the aforesaid openings 58.

In such an apparatus as illustrated in FIGS. 1 to 6, it is also important to use means permitting to avoid any deposit of solid sediments in the chamber 23, containing the heavy phase, and in the annular passage 22 giving access thereto. To this effect, any sediments depositing against the wall 2 in the region of the partition 20 have to be scraped and taken off by the conveyor 7. To this end, a flat ring 62 is secured, by welding for example, on the rotor 17 at its end adjacent the first spire 56 or 57. Said ring supports, via a stand 63, at least one scraping element 64 which extends closer to the cylindrical wall 2 of the enclosure, from the said first spire 56 or 57 and up to the entry passage 22. In the example shown, two scraping elements are provided, but of course there can be more.

Moreover, according to the first embodiment (FIG. 7) the scraping elements 64 extend along the generatrices of the wall 2; according to the second embodiment (FIG. 8) on the contrary, the said scraping elements form with the aforesaid generatrices an angle b which can vary between 0° and 45°.

FIGS. 5 to 8 clearly show a labyrinth pack 65 interposed between the ring 62 and the stepped partition 20 in order to avoid any disturbances being propagated from the passage 20 and the first spire of the conveyor towards the chamber 24 and/or the chamber 23.

In the second embodiment illustrated in FIGS. 9 to 11, the centrifuge rotor 18 is constituted by a stack of conical plates 66 joined together by elongated members 67 and 68 suitably distributed on their inner and outer peripheries respectively. Said rotor is fixed on driving plates 15 and 16 coupled to the driving pulley 14 as well as in the conveyor 7 and, if its rigidity is not sufficient, an outmost support wheel 42 to 44 and if necessary intermediate wheels, may also be provided.

The conicity of the said plates 66 may vary between 70° and 100° and be preferably equal to 80°, in order to trap and to channel the heavy and light particles with the same results of phase separation as with the previous embodiment. The said plates are also provided on one of their faces with projecting bars 70 or 71, which bars when the rotor is constituted, are situated in the conical tubular channels separated by the said plates and through which flow the phases. The said bars permit to transmit to the said phases the rotation at constant angular speed. In the embodiment illustrated in the upper part of FIG. 11, the bars 70 extend along the generatrices of the plates, in radial planes. In the other embodiment illustrated in the lower part of said Figure, the bars 71 are inclined with respect to the said radial planes.

According to the third embodiment (FIGS. 12 and 13) the centrifugal rotor 19 is constituted by a stack of substantially plane coronal discs 73; these are joined together by inner longitudinal members 74 and by a perforated grid 75 or peripheral cage on which the conveyor 7 is fixed.

Said rotor 19, which can be reinforced by at least one support wheel 42 to 44 if necessary, is fixed on the driving plates 15 and 16 coupled to the driving pulley 14.

Each plate 73 defines a plurality of trapezoidal apertures 76 distributed in equiangular manner and separated one from the other by screens 77 formed by the solid part of the actual plate. An important fact to be noted is that the plates are angularly offset with respect to one another.

Moreover, each aperture of slot is defined, on one side, by a sharp edge 78 and, on the other side, by a flange 79 projecting in the intercalated spaces 77. The flanges 79 channel the heavy phase towards the periphery and take an effective part in driving the phases in rotation at constant angular speed. Said lateral flanges 79 are radial in the example shown, but they can also be inclined with respect to the radial directions to form therewith an angle at the most equal to 40°; in addition, they can also be extended by a marginal flange 80.

Of course, it is also possible, and can be advantageous, for the centrifuge device 49 to have the same design as the centrifuge devices 17, 18 or 19.

The invention is not limited to the embodiments illustrated and described herein and modifications may be made thereto without departing from its scope.

The method and apparatus for performing the method find application for example in the extraction of animal and vegetable fatty substances, in the extraction of essential oils, in the production of fat-free animal proteins, in the recovery of polymers from solvent-water mixed mediums, in the extraction of antibiotics, in metallurgical refinings by selective solvents, in the desalination of sea water by the solvent method, in the treatment of waste waters, etc. . . .

What is claimed is:

1. An improved apparatus for the centrifugal separation of at least two liquid phases and one solid sedimentary phase from a mixture, the said apparatus comprising: a rotating enclosure, first rotational means for rotating said enclosure, said rotating enclosure disposed around a nozzle supplying the mixture to be treated, said rotating enclosure being closed by a coronal base and coupled to said first rotation means for driving it in rotation, the said enclosure being integral with an angular partition therein which plunges into the mixture beyond the interface of the phases thereof, said partition separating a first chamber in said enclosure containing only the heavy phase from a second chamber in said enclosure containing the light phase "floating" on the heavy phase, said partition providing a peripheral annular passage for the transfer of the said heavy phase from the second chamber towards the first chamber, said first chamber being defined by a peripheral wall, said coronal base and said partition wall, the enclosure further presenting separate thresholds for the draining of the phases, a helical sediment conveyor within said enclosure, a second rotation means coupled to said conveyor via a plate which plunges into the mixture beyond the said interface, said plate separating the second chamber from a cavity in said enclosure with which said second chamber communicates on the periphery via a space near the conveyor for transferring the sediments through the heavy phase, a first centrifuge device housed in the first chamber and integral with said peripheral wall, said partition wall and said base thereof provided with surfaces extending inside the entire treated volume, across their circular movement, in order to transmit the rotation of the first driving means to the heavy phase according to an angular speed which is scrupulously constant throughout its whole mass and in every one of its points;

a second centrifuge device housed in the second chamber and integral with said plate and with said conveyors, said second centrifuge device plunging at least into the light phase of the second chamber, said second centrifuge device extending along the said second chamber to arrive as close as possible to the partition wall, to the light phase draining threshold and to the annular passage of the heavy phase, and being provided with surfaces extending through the entire treated volume, across their circular movement, in order to transmit the rotation of the second driving means to at least the light phase, according to an angular speed which is scrupulously constant throughout its whole mass and in every one of its points, thus opposing the natural tendency of this type of flow with constant angular speed to degenerate into an irrotational vortex flow with tangential speed inversely proportional to the radius, which would destroy the stability of the interface and would lead to a re-mixing of the phases, a device for controlling the two means for driving the centrifuge devices for stabilizing and regulating the ratio of their respective rotation speeds.

2. An apparatus as claimed in claim 1 wherein the means for regulating the conjugated operation of the two rotation means cooperates with a control member which is sensitive to the densities and to the limpidities the two liquid phases measured at the draining thresholds.

3. An apparatus as claimed in claim 1, wherein the means for regulating the conjugated operation of the two rotation means cooperates with a control member which is sensitive to the limpidities of the liquid phases measured optically at the draining thresholds.

4. An apparatus as claimed in claim 1 wherein said first centrifugal device comprises longitudinal driving blades, and wherein the said blades, arranged in the first chamber are substantially radial and present an indentation of a limited size opposite the annular passage.

5. An apparatus as claimed in claim 1 wheren said second centrifugal device comprises longitudinal driving blades and wherein said blades, arranged in the second chamber are inclined with respect to the radial directions so as to form therewith an angle which can vary between 20° and 70°, and is preferably equal to 40°.

6. An apparatus as claimed in claim 1 wherein at least one centrifugal device comprises a stack of conical plates, and wherein plates, situated in the first and/or second chamber for positively driving the liquid phase or phases, have a conicity which may vary between 70° and 100°, and are separated by projecting bars, inclined with respect to the tangential directions, and preferably radial.

7. An apparatus as claimed in claim 1 wherein at least one centrifugal device comprises a stack of perforated and flanged plates, perpendicular to the axis of rotation and whose perforations are defined by a projecting flange, wherein the said flanges form with the radial directions an angle varying between 0° and 40°.

8. An apparatus as claimed in claim 1, wherein the outmost spire of the conveyor situated near the partition separating the two chambers, is perforated to establish another direct communication between the said chambers, said perforation permitting to avoid the repumping of the light phase up towards the heavy phase.

9. An apparatus as claimed in claim 8 wherein a labyrinth pack is interposed between the partition separating the two chambers and a continuous central ring of the conveyor.

10. An apparatus as claimed in claim 1 wherein the end of the conveyor situated near the partition separating the chambers is integral with at least one scraping element extending close to the peripheral wall, and is directed into the annular passage in order to avoid any deposit of sediments in the first chamber containing the heavy phase, said scraping element forming with a generatrix of the enclosure an angle varying between 0° and 45°.

11. An appartus as claimed in claim 1, whose draining thresholds are adjustable pipes carried by the peripheral wall and extending from the centre towards the periphery to issue on the outside of the enclosure and flush with, respectively, the free surfaces of the light and heavy phases in the chambers containing them, and wherein:

the partition rises in step manner and is provided with a skirt connecting a central flank with a peripheral flank, the pipes picking up the light phase traverses the skirt by resting against the peripheral flank in the first chamber containing the heavy phase and against the central flank in the second chamber containing the light phase in that spot.

* * * * *